United States Patent [19]

Chase et al.

[11] Patent Number: 4,767,963

[45] Date of Patent: Aug. 30, 1988

[54] SHADOW MASK COLOR CRT WITH ENHANCED RESOLUTION AND/OR BRIGHTNESS

[75] Inventors: Brian D. Chase; Andrew Paton, both of Eastleigh, England

[73] Assignee: International Business Machines Corporation, Armonk, N.Y.

[21] Appl. No.: 876,530

[22] Filed: Jun. 20, 1986

[30] Foreign Application Priority Data

Jun. 28, 1985 [EP] European Pat. Off. ..... 85304638.1

[51] Int. Cl.[4] ..... H01J 29/07

[52] U.S. Cl. ..... 313/408; 313/402

[58] Field of Search ..... 313/403, 408, 402

[56] References Cited

U.S. PATENT DOCUMENTS 4,100,452 7/1978 Kaplan ..... 313/408

4,392,914 7/1983 Takenaka et al. ..... 313/402 X

FOREIGN PATENT DOCUMENTS 3057 1/1978 Japan ..... 313/408

*Primary Examiner*—Palmer C. DeMeo

*Attorney, Agent, or Firm*—Alexander Tognino; Philip J. Feig

[57] ABSTRACT

A color CRT has stripes of different color light emission phosphors (r, g and b) deposited on a faceplate of the tube with the relative widths of the stripes being inversely proportional to the light emission efficiency of the phosphors. By this means the integrated brightness of the emitted light from the different phosphor stripes is the same for the same value beam current. By using a novel double shadow mask arrangement, the widths of the beams from the three guns can be made to match, or substantially to match, the widths of the phosphor elements on which they land. Specifically, the beam from one gun is aligned with apertures through both masks in order to transmit a relatively wide portion of the beam onto the least efficient, phosphor. The portion of the beams transmitted by the first mask for the other two guns are further clipped by the relatively off-set apertures in the second mask. This arrangement enables the advantage of the balanced color output from the screen to be enjoyed without loss of purity margin and provides a significant increase in brightness for a given beam current and/or resolution of the screen. The invention is applicable to CRTs employing shadow masks with slots and phosphor stripes, or holes and phosphor dots and also for CRTs driven in raster scan or vector mode.

8 Claims, 3 Drawing Sheets

SHADOW MASK COLOR CRT WITH ENHANCED RESOLUTION AND/OR BRIGHTNESS

BACKGROUND OF THE INVENTION

1. Field of the Invention

This invention relates to a shadow mask color cathode ray tube (CRT) with enhanced resolution and/or brightness.

2. Description of Related Art

As is well known, color CRT's normally have three electron guns producing so-called 'red', 'green' and 'blue' electron beams which are used respectively to stimulate red, green and blue phosphor elements on the CRT faceplate. By stimulating these three primary—color phosphors by different amounts and in different combinations, any color mix can be displayed on the screen. Multi-beam color cathode ray tubes are of two types, either delta gun where the three guns are placed at the apexes of a triangle, or in-line gun where the three guns are located along a line normally parallel to the direction of line scan. A shadow mask is employed which consists of a large number of apertures across the horizontal dimension of the CRT (i.e. the scan line dimension in the case of a raster scan CRT), either provided as circular holes or elongated slots through which the beams are directed onto the phosphors. Each aperture has three phosphor elements associated with it, namely red, blue and green emitting elements for each scan line. The 'red,' 'blue' and 'green' electron beams are directed through the apertures at different angles so that each stimulates the appropriate phosphor. Convergence circuits and assemblies ensure that at any one time the three beams are coincident at the phosphor screen. Purity circuits and assemblies ensure that the beams pass through the apertured shadow mask at the correct angle so as to stimulate the correct phosphor element.

A known problem with such color CRTs is that the brightness level of the three different color phosphors is different for the same beam current. Typically, the brightness of the red phosphor is significantly less than that of the blue or green phosphors for the same beam current. In order to achieve an adequate white color point (as defined by a selected point on the CIE chromaticity diagram), it has been common practice to drive the three guns with different value beam currents in order to compensate for the different brightness levels of the phosphors. A consequence and disadvantage of this is that the gun with the largest beam current has a reduced performance in terms of spot size and cathode life and a mismatch of resolutions can occur since spot size is dependent on beam current.

One way of resolving this problem is to vary the size of the phosphor dots or stripes on the CRT faceplate so that the integrated light emission from each phosphor element is constant for the same beam current. Accordingly, the smallest elements are composed of the phosphor exhibiting the highest luminance characteristic and the larger elements are composed of the phosphors exhibiting the lower luminance characteristics. A process for making a CRT screen in which different size phosphor elements are utilized to compensate for different luminance characteristics is described in U.S. Pat. No. 2,687,360. In this example, the relative areas of the different phosphor types are such that the integrated brightness from each element is substantially the same. A further example is to be found in European Pat. No. 0129620 in which the lower brightness efficiency of the red phosphor is compensated for by increasing the size of the red dots or stripes relative to the size of the blue and green dots or stripes.

A disadvantage of this approach is that any increase in the size of a phosphor dot or stripe also necessarily reduces the purity margin. (Purity margin in this context is defined as the distance between the edge of a beam projected through an aperture in the shadow mask onto its associated phosphor dot or stripe and the nearest adjacent phosphor dot or stripe of a different color). Fidelity of color is an important requirement of CRTs in general and particularly for CRTs used in the data and graphic display terminals. Thus, although it is desirable to balance the phosphor emissions in the manner described above it is important to ensure that the performance of the CRT is not degraded in other respects as a consequence.

It is therefore an object of the present invention to balance the phosphor light emission by means of the technique described above without any loss in purity margin. Additionally, as will be shown herein, not only does the modification overcome the problem of reduced purity margin, but CRTs incorporating the invention can be provided with a higher screen resolution and/or brightness for a given level of screen processing cost and technology.

SUMMARY OF THE INVENTION

Briefly, the invention comprises substituting a double mask combination of two spaced-apart shadow masks for the conventional single layer mask. Each mask in the combination has corresponding apertures positioned such that when the combination is assembled and in place within the CRT, the pairs of corresponding apertures in the two masks are aligned with respect to the beam from only the gun associated with the least efficient phosphor. The size of the apertures in the mask is chosen so that the width or cross-section area of a portion of a transmitted beam from this gun matches the width or cross-section area of the phosphor element on which it lands. Since the other two guns are off-set with respect to this gun their respective beams clearly are not aligned with the pairs of apertures through the two masks. The spacing between the masks in the combination is made such that the portions of the beams from the two off-set guns transmitted through the first shadow mask are further clipped by predetermined amounts as they pass through the off-set apertures in the second shadow mask. By selection of aperture size and shape and mask separation the width or cross-section area of the portions of the beams from the two off-set guns transmitted through the shadow mask combination can also be accurately controlled and made to match the width or cross-section area of the smaller sized phosphor elements on which they land. By careful control of the various geometries of the tube it is possible to match the transmitted beam sizes with the respective sizes of the associated phosphor elements to a fair degree of accuracy. By this means, the advantage of balanced color output from the phosphors is achieved without losing purity.

Since an increase in size of the lowest efficiency phosphor is accompanied by a reduction in size of the higher efficiency phosphors, the size of the lowest efficiency elements can be made larger than in a conventional CRT for the same packing density. This means the apertures in the two mask combination are made correspondingly larger so that the size of the transmitted beam from the aligned gun matches the size of the associated elements. It is seen therefore, that for a CRT in accordance with the present invention with the same phosphor element packing density as a conventional CRT there will be an increase in relative brightness. Alternatively, if the size of the least efficient phosphor elements is not increased relative to the size of the corresponding elements in conventional CRT, then because the sizes of the other two phosphor elements are correspondingly smaller, the packing density can be increased accordingly, with an increase in screen resolution. Clearly, various CRT constructions with increase in brightness and increase in resolution between the two extremes are possible.

In order that the invention may be fully understood, preferred embodiments thereof will now be described with reference to the accompanying drawings.

DETAILED DESCRIPTION OF THE INVENTION

Figure 1:
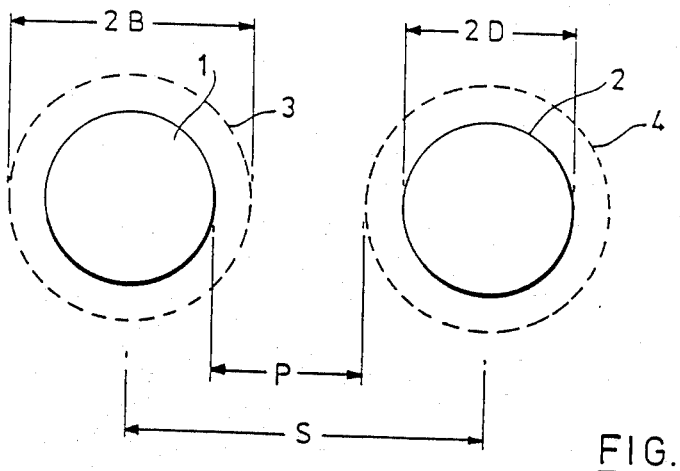
FIG. 1 shows schematically the relative positions of transmitted electron beams through a shadow mask and phosphor dots of equal size, and is used to illustrate the meaning of 'purity margin'.

In FIG. 1, two adjacent phosphor dot elements 1 and 2 of different color emissions are shown schematically as they are typically provided on the faceplate of a conventional CRT. The spacing between the phosphor dot centers is shown as S and each individual dot is of diameter 2D. The cross-section areas of the electron beam through the shadow mask landing on the phosphor dots are represented by the broken outlines 3 and 4. The diameter of the transmitted beam through the shadow mask is shown as 2B. As has been stated hereinbefore, the purity margin P is defined as the shortest distance between the edge of an electron beam (such as 3 or 4) transmitted through the shadow mask onto a phosphor element (such as 1 or 2) and an edge of an adjacent phosphor element of a different color (such as 2 or 1). It should be noted that where, as in this case, a black matrix is employed in the faceplate structure, the edge of the phosphor element is that edge defined by the black matrix even though the matrix and phosphor element overlap. Accordingly, the purity margin P in a conventional CRT is given by the expression:

$$P=S-D-B$$

Figure 2:
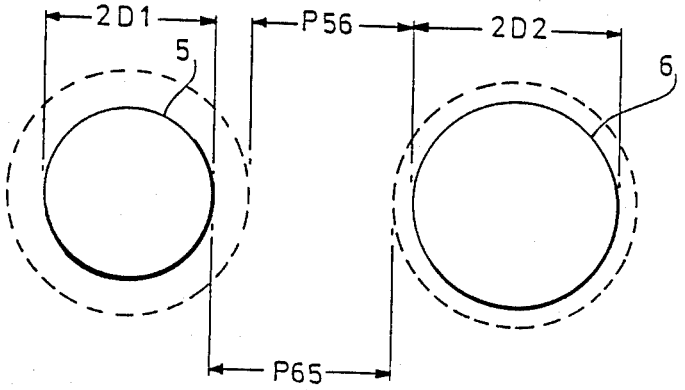
FIG. 2 shows schematically the relative positions of transmitted electron beams through a shadow mask and phosphor dots of different sizes selected to provide a balanced light output from all phosphor elements for the same beam current, and is used to illustrate the degradation of purity margin caused by the increase in size of one phosphor element relative to another adjacent element.

FIG. 2 shows how the purity margin is affected by a change in relative dimensions of adjacent phosphor elements such as may be employed in order to balance their different emissive efficiencies. In this case, a relatively small element 5 of a high emission efficiency phosphor is shown adjacent a relatively large element 6 of a lower emission efficiency phosphor. The diameters of the elements 5 and 6 are shown as 2D1 and 2D2 respectively. The spacing S and beam cross-section diameter 2B are the same as in the example of a conventional CRT illustrated in FIG. 1. With this modified arrangement, it can be seen that there are now two purity margins, $P_{56}$ and $P_{65}$ where $$P_{56}=S-D2-B$$

and $$P_{65}=S-D1-B$$

It is seen from this FIGURE that whenever the size of a phosphor dot is increased relative to that of its neighbor, one of the two purity margins, either $P_{56}$ or $P_{65}$ will be reduced. For a slotted mask CRT the purity margin considerations are similar but only the horizontal dimension need be considered.

Figure 3:
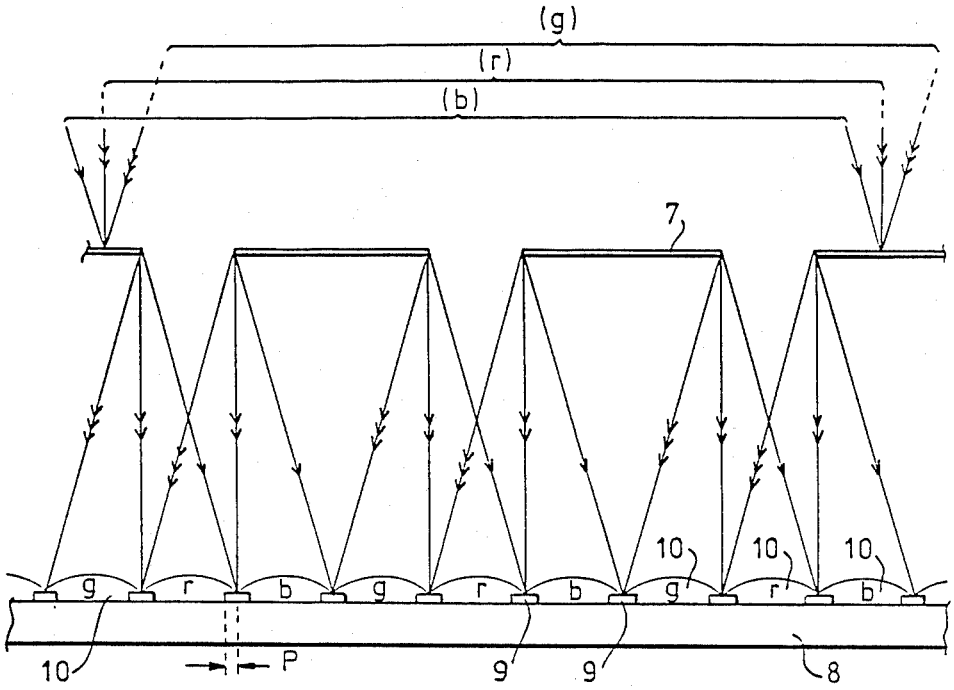
FIG. 3 shows schematically a section in the horizontal direction (i.e., the scan line direction in the case of a raster-scanned CRT) through a portion of a slotted shadow mask and faceplate of a conventional CRT.

FIG. 3 shows schematically a section in the horizontal direction through a portion of a slotted shadow mask 7 and faceplate 8 on which phosphor elements 10 are deposited as longitudinal stripes parallel to the slots in the shadow mask. In the case where the CRT employs a raster scan, the horizontal direction is the beam scan direction, that is, the direction orthogonal to the longitudinal axes of the slots and stripes. The phosphor stripes 10 are provided as a repetitive sequence of green (g), red (r), and blue (b) elements on the inside surface of the faceplate 8 with the individual edges of the phosphor elements being defined by a conventional black matrix 9. The electron beams from the three guns (not shown) are represented by lines and distinguished from each other for the sake of simplicity by the number of arrows each carries. Thus, the beam from the 'blue' gun is represented by the lines carrying single arrows; the beam from the 'red' gun by lines carrying two arrows; and the beam from the 'green' gun by lines carrying three arrows. The widths of the beams from the guns are such that, in this example, they extend over three slots in the shadow mask 7. The portions of these three beams transmitted through the slots in the mask are shown landing on the stripes of appropriate color emission phosphor. The purity margin P is shown in the FIGURE as the distance between the edge of a transmitted portion of a beam and the edge of the adjacent phosphor element defined by the intervening portion of the black matrix.

Figure 4:
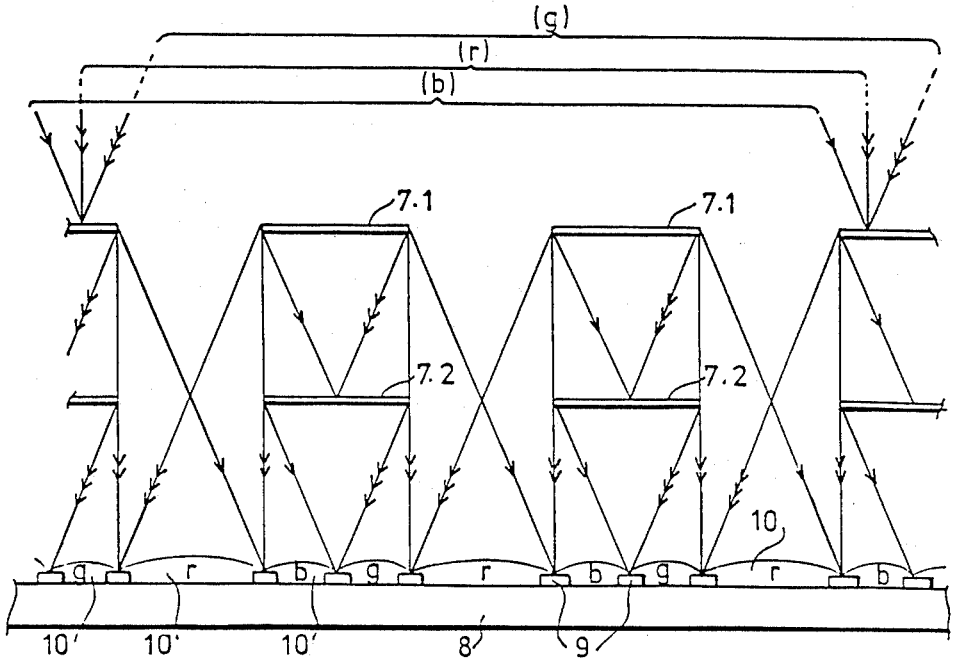
FIG. 4 shows schematically a similar section through a corresponding portion of a CRT modified in accordance with the present invention.

FIG. 4 shows schematically a similar section through a corresponding portion of a CRT in which the widths or areas of the phosphor stripes 10 are roughly inversely proportional to the light emission efficiencies of the phosphors so that the three guns can be driven with the same beam currents and a balanced light output be obtained. It is assumed in this example that the red phosphor is the least efficient with the blue and green phosphors of about the same efficiency as each other, and about twice that of the red phosphor. Accordingly, the red phosphor stripes on the faceplate are twice as wide as the blue and green stripes.

The modification, in accordance with the present invention, to the CRT shown in FIG. 4 consists of the provision of a double mask combination of two shadow masks 7.1 and 7.2 in place of the single mask 7 in the conventional arrangement. The two masks in the combination each have corresponding slotted apertures aligned with respect to each other and with a selected one of the three guns, in this case the 'red' gun, so that the portions on the beam from the red gun transmitted through the aperatures in the first mask 7.1 are unaffected or substantially unaffected by the second mask are transmitted therethrough to be incident on the widest phosphor stripes, in this case the 'red' phosphor stripe, on the faceplate of the CRT. Since the apertures in the two maszk combination are only aligned with respect to the gun, the portions of the beams from the other two guns transmitted through the aperatures in the first mask 7.1 of the combination are clearly further clipped by the second mask 7.2 and reduced in width accordingly. The positions of the two masks in the combination are selected having regard to the overall geometry of the CRT such that the widths of the final portions of the beams transmitted through the combination from the green and blue guns 10 match the widths of the green and blue phosphor stripes on which they land. In this example, the width of the transmitted beam from the blue and the green gun is half the width of the transmitted portions of the aligned red beam.

The example chosen to illustrate the invention represents the simplest case where it is assumed that the green and blue phosphors have about the same emission efficiency, namely twice that of the red phosphor. In practice, it is unlikely that the emission efficiencies of the blue and green phosphors will in fact be the same. Furthermore, the red phosphor is not necessarily always the problem phosphor since this depends on the C.I.E. color points selected for the display. It may be, in some circumstances, the 'blue' or even the 'green' elements may require to be provided as the larger phosphor area.

It is seen therefore that the design of a CRT in accordance with the invention will depend upon the particular combination of phosphors selected. Below in tabular form are three different phosphor combinations for comparison. In each case the first column gives brightness of the emission for phosphors of equal areas for a beam current of 250 μA; the second column gives the ratios of brightness required for the particular phosphors to achieve an acceptable white; the third column gives the ratio of phosphor area (widths in the case of phosphor stripes) such that equal beam currents produce this white; and the fourth column gives the brightness values for elements with the areas of the third column to produce the required white. It is seen that these values are in fact in the desired ratio set out in the second column.

1. LONG PERSISTENCE PHOSPHORS

| | Brightness Cd/m² at 250 μA | Brightness Ratios for White | Phosphor Areas for Equal Currents | Brightness Cd/m² at 250 μA with Derived Area Ratios |
|---|---|---|---|---|
| Red | 19.1 | 1 | 1.47 | 28.1 |

-continued

| | Brightness Cd/m² at 250 μA | Brightness Ratios for White | Phosphor Areas for Equal Currents | Brightness Cd/m² at 250 μA with Derived Area Ratios |
|---|---|---|---|---|
| Green | 46.875 | 1.2 | 0.72 | 33.75 |
| Blue | 31.25 | 0.9 | 0.81 | 25.3 |

It is seen from the fourth column that the brightness for the red phosphor is increased but that for the green and blue is reduced.

In view of this relatively larger area of the red phosphor, the increase in brightness in the red, and hence the overall brightness of the screen is 47%.

The improvement in brightness is even greater if a higher efficiency green phosphor which has recently become available is used. The double mask technique enables this highly efficient green phosphor to be exploited to the full, whereas it would otherwise be pointless to use it in a conventional tube since the beam currents and hence beam sizes would be grossly unbalanced. Details of a phosphor combination including this new 'green' phosphor are as follows:

2. LONG PERSISTENCE PHOSPHORS WITH HIGH EFFICIENCY GREEN

| | Brightness Cd/m² at 250 μA | Brightness Ratios for White | Phosphor Areas for Equal Currents | Brightness Cd/m² at 250 μA with Derived Area Ratios |
|---|---|---|---|---|
| Red | 19.1 | 1 | 1.676 | 32 |
| Green | 65.625 | 1.2 | .615 | 40.36 |
| Blue | 40.625 | 0.9 | .709 | 28.8 |

The gain in brightness of red and hence the overall brightness in this example is 68%. Finally, details for a combination of short persistence phosphor is as follows:

3. SHORT PERSISTENCE PHOSPHORS

| | Brightness Cd/m² at 250 μA | Brightness Ratios for White | Phosphor Areas for Equal Currents | Brightness Cd/m² at 250 μA with Derived Area Ratios |
|---|---|---|---|---|
| Red | 24.5 | 1 | 1.417 | 34.7 |
| Green | 90 | 1.9 | 0.733 | 66 |
| Blue | 49 | 1.2 | 0.885 | 41.65 |

It should be noted that since the short persistence phosphors have different color point relative to the long persistence phosphors in the previous two examples the brightness ratios required for the same C.I.E. color point are different. In this case, it is seen that gain in brightness for red and hence the overall brightness is 42%.

Figure 5:
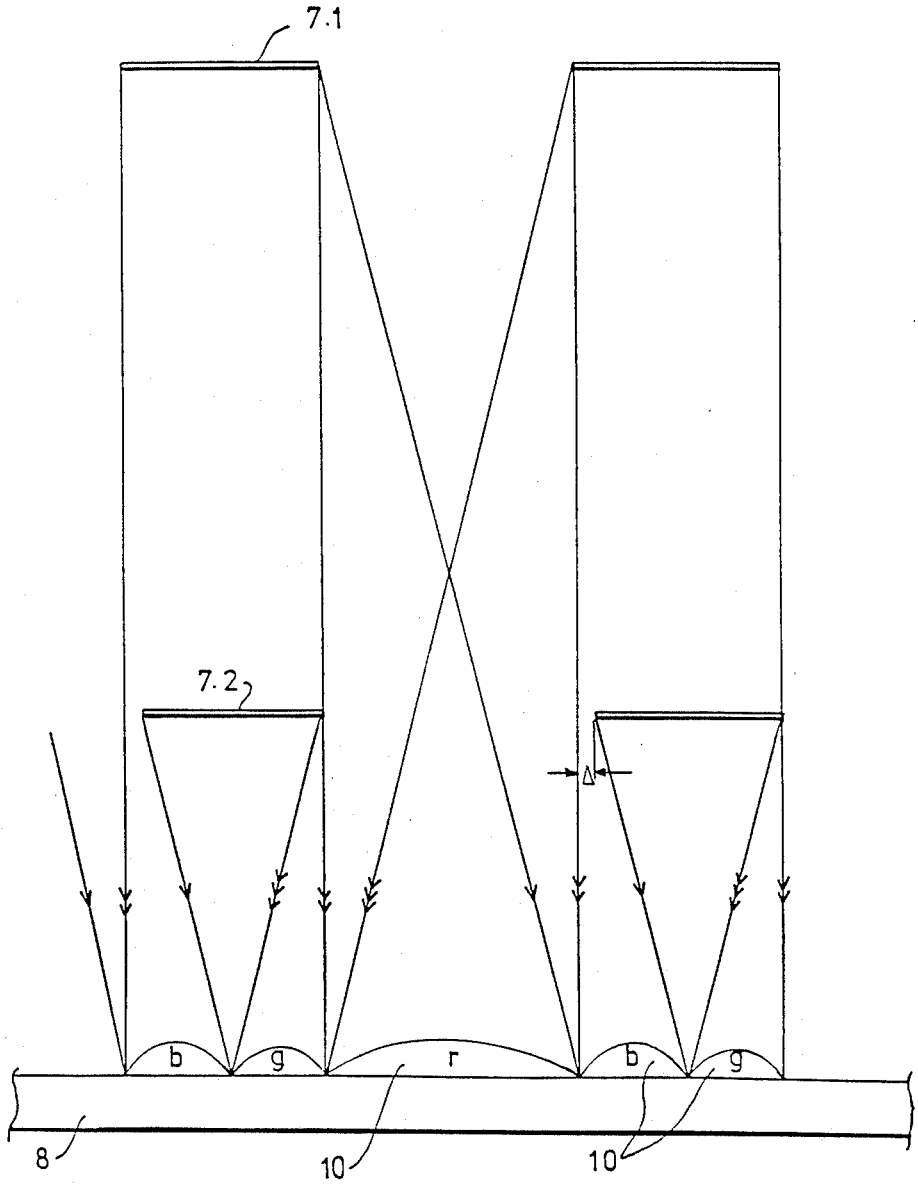
FIG. 5 shows a specific double mask combination such as may be used in the arrangement shown in FIG. 4, which enables the widths of the transmitted portions of beams from the three guns to match three different sized phosphors with which they are associated.

From the FIGURES in the three examples of phosphor combinations given above, it is seen that although the green and blue phosphor sizes are nearer to each other, they are not the same. However, as it will now be shown with reference to FIG. 5, the relative positions of the two masks in the double mask combination can be calculated and aperture sizes selected so that the beams landing on the phosphors match or substantially match the widths of the associated phosphors. The example chosen for illustration in FIG. 5 is that using the highly efficient green phosphor of example 2 given above. In the FIGURE only the portion of the double mask combination including one aperture is shown for simplicity.

The phosphors on the screen faceplate have the relative sizes of red 1.676, green 0.615 and blue 0.709 as shown in the table. The aperture in the top mask 7.1 is used to define the width of the red beam and therefore has a dimension of 1.676S relative to an aperture spacing in the horizontal direction of 3S. In the example, the left side of the green beam (the smallest phosphor area) is defined by the left-hand edge of the aperture in the lower mask 7.2. The separation h of the mask from the screen is given by the following expression:

$$h = \frac{gQ}{r}$$

where

Q is the distance between the top mask 7.1 and the screen (referred to as the Q space)

g is the relative width of the green phosphor element r is the relative width of the red phosphor element therefore $$h = \frac{0.615}{1.676} Q = 0.367Q$$

The right-hand edge of the aperture in the lower mask 7.2 defines the right-hand side of the blue beam. For this to be larger than the green beam, the aperture must be larger than that of the top mask 7.1 by an amount Δ where:

$$\Delta = (b - g) = 0.094$$

where b is the relative width of the blue phosphor.

The center of this aperture is off-set to the right relative to the top aperture by a distance $$\Delta/2 = 0.047$$

It should be observed that in the example described with reference to FIG. 5, the aperture in the upper shadow mask 7.1 is larger than normal for a given pitch. In the example it is 68% larger. This has the important advantage of being easier to etch during manufacture. If on the other hand the aperture size in the upper mask 7.1 is not increased then the pitch can be reduced. Accordingly, this gives a higher resolution screen for a given level of etching cost and technology. For example, if a slot mask screen has a pitch of 0.31 mm, then each aperture will be approximately 0.1 mm width. In the example shown in FIG. 5 this could be increased to 0.16 mm. However, with allowances for purity, the apertures could be left at 0.1 mm and the pitch reduced by 30% to about 0.2 mm. Thus a screen resolution improvement of about 30% is possible. It is worth observing also that since the low mask 7.2 does not receive such intense electron beam bombardment as the upper mask, its thermal tolerances are lower and accordingly the purity, especially at the boundary of the green and blue phosphor elements, is more controlled.

The examples refer to slotted mask CRTs but it can be seen that in principle the invention also applies equally to a dot mask CRT although in this case it may not be possible to exactly match the area of the transmitted beam with the area of the associated phosphor element on which it lands. However, even if the precise matching may not always be possible, the beam sizes can be made to approach the associated element sizes and the advantages of the invention are obtained with a considerable improvement over the prior art arrangement with no beam trimming.

Finally, it should be realized that it is not the intention to limit the scope of the present invention to raster-scan CRTs, since it is equally applicable to CRT operating in vector driven mode. For this reason the reference to the width of beam or aperture in the appended claims means the width measured in the horizontal direction as is understood by the common terminology in relation to CRTs. Thus, for example in a raster-scan CRT, the horizontal direction is in the scan-line direction.

Having thus described our invention, what we claim as new, and desire to secure by Letters Patent is:

1. A color CRT having a plurality of guns each gun adapted to produce an electron beam to stimulate a different associated group of color phosphors areas, on the face of the CRT, the relative areas of the different groups of color phosphors on the CRT faceplate are inversely proportional, or substantially inversely proportional, to their light emission efficiencies in order to produce a color balance which gives an acceptable white color point when all the guns are driven with the same value of beam current, the improvement comprising: a masking arrangement for the CRT with a double shadow mask combination comprised of first and second spaced apart shadow masks, each of said masks having a corresponding pattern of apertures therethrough, the construction and arrangement of said masks is such that the widths of the portions of the electron beams emerging from said masks all match, or substantially match, the areas of the associated group of color phosphors on the faceplate on which they land.

2. A color CRT as claimed in claim 1, wherein the widths of the portions of the electron beams emerging from said masks and associated with a particular group of color phosphors being determined by an off-set between the apertures in the first mask and the corresponding apertures in the second mask relative to the beam direction from the associated gun as it passes through the aligned or partially aligned apertures in the first and second masks during scanning.

3. A color CRT as claimed in claim 2, wherein the apertures in the first and second mask are aligned with respect to the beam direction from the gun associated with the group of color phosphors having the lowest light emission efficiency and in which the size and shape of the apertures in the second mask are such as not to interfere with the portions of the electron beam from said associated gun passing through said first mask.

4. A color CRT as claimed in claim 3, incorporating three in-line guns and shadow masks having slotted apertures, said gun associated with the group of color phosphors having the lowest light emission efficiency being centrally positioned with respect to the other two guns and aligned with the pairs of corresponding slotted apertures through said first and second masks so that the width of a transmitted portion of the beam from that gun through the mask combination is defined by the edges of the slotted aperture in the first mask through which the beam passes; the width of a transmitted beam from the other gun disposed to the left of the control gun being defined by the lefthand edge of the aperture in said first mask and the righthand edge of the corresponding aperture in said second mask through which the beam passes; and the width of a transmitted beam from the other gun disposed to the right of the central gun being defined by the righthand edge of the aperture in said first mask and the lefthand edge of the corresponding aperture in said second mask through which said beam passes.

5. A color CRT having a plurality of guns each gun adapted to produce an electron beam to stimulate a different associated group of phosphors areas, the relative areas of the different groups of color phosphors on the CRT faceplate are inversely proportional, or substantially inversely proportional, to their light emission efficiencies in order to produce a color balance which gives an acceptable white color point when all the guns are driven with the same value of beam current, the improvement comprising: a masking arrangement of the CRT with a double mask combination comprised of first and second spaced apart shadow masks the first shadow mask having apertures therethrough for transmitting unmasked portions of the beams from the guns of a width to match, or substantially to match, that of the areas of the group of color phosphors on the faceplate with the lowest light emission efficiency, and the second shadow mask intermediate the first shadow mask and faceplate having apertures therethrough corresponding to apertures in the first mask, the pairs of corresponding apertures in the two masks being aligned with respect to the beam from that gun associated with the group of color phosphors with the lowest light emission efficiency and the size of the apertures in the second mask and its position relative to the first mask being such that the unmasked portions of the electron beams transmitted through the first mask from the gun associated with the group of color phosphors of lowest light emission efficiency are transmitted through the second mask substantially unchanged, whereas the unmasked portions of the beams transmitted through the first mask from the remaining guns are partially blocked by the second mask to an extent necessary for widths of the unmasked portions of the beams emerging from the mask combination to match, or substantially to match, the widths of the associated group of color phosphors as aforesaid.

6. A color CRT having in-line guns for selectively exciting to luminescence, through apertures in a shadow mask arrangement, respective phosphor elements on a screen, the phosphor elements being arranged across the screen in groups, each phosphor element in a group providing a different color light emission upon excitation by the electron beam from its associated gun and in which the relative areas of the phosphor elements in a group are substantially inversely proportional to their respective relative light emission efficiencies, the improvement comprising:

a double mask combination comprised of first and second spaced apart shadow masks each of said masks having a corresponding pattern of apertures therethrough constructed such that the effective lengths of apertures therethrough are substantially greater than their widths whereby, in combination with the relative off-sets of the in-line guns with respect to the apertures, the emergent beam from one of said in-line guns through an aperture is of substantially greater width than that of the emergent beams from the remaining in-line guns through the same aperture, and the distribution of the phosphor element over the screen is such that the phosphor element in a group having the lowest emission efficiency is positioned so as to be excited by the gun with the widest emergent beam from the associated aperture in the mask.

7. A color CRT comprising: a group of in-line guns for generating electron beams; means for deflecting the beams synchronously to follow scan lines in a raster across the screen of the CRT; a double shadow mask combination comprised of first and second spaced apart shadow masks in the vicinity of the screen providing a plurality of apertures therethrough in the scan line direction; an array of phosphor elements on said screen arranged in groups aligned along the scan lines of the raster with each individual group in any one scan-line being uniquely associated, one for one, with an individual aperture of said plurality of apertures, each group of phosphor elements containing as many phosphor elements as there are guns in the group of in-line guns, each phosphor element in a group having a different color emission characteristic from any other phosphor element in the group, and the width of the phosphor element with the lowest emission efficiency being greater than the width of the remaining elements in the group, the alignment of each aperture with respect to its associated group of phosphor elements and the group of in-line guns, and the relative positions of the phosphor elements in the group on the screen being such that each individual phosphor element in a group is uniquely associated one for one with an individual gun from said group of guns, such that the unmasked portion of a beam from one gun transmitted therethrough is of significantly greater width in the scan-line direction than the unmasked portions of the beams from the remaining guns, and the distribution of phosphor elements in each group of phosphor elements is arranged such that the phosphor element with the lowest light emission efficiency is associated with the gun transmitting the widest beam through said double shadow mask combination.

8. A color CRT having off set red, blue and green in-line guns for selectively exciting to luminescence through apertures in a shadow mask arrangement respective red, blue and green primary phosphor elements on a screen, the area of each of the red phosphor elements being greater than the area of each of the blue and green phosphor elements thereby to compensate for the lower emission efficiency of the red phosphor relative to the blue and green phosphors the improvement comprising:

a shadow mask arrangement of a double shadow mask combination of first and second spaced apart shadow masks, each of said masks having a corresponding pattern of apertures therethrough constructed and arranged such that the effective lengths of apertures therethrough are substantially greater than their widths in the scan-line direction whereby, in combination with the relative off-sets of the in-line guns with respect to each aperture, the relative widths in the scan-line direction of the three emergent beams from an aperture are substantially directly proportional to the widths of the corresponding phosphor elements in the scan-line direction associated therewith.

* * * * *